US005161333A

United States Patent [19]

Lecerf et al.

[11] Patent Number: 5,161,333

[45] Date of Patent: Nov. 10, 1992

[54] DEVICE FOR RECALIBRATING A MACHINE FOR GRINDING OPHTHALMIC GLASSES

[75] Inventors: Michel J. M. Lecerf, Amfreville La Campagne; Jean-Pierre M. F. Langlois, Rouen, both of France

[73] Assignee: Briot International, Pont De L'Arche, France

[21] Appl. No.: 496,232

[22] Filed: Mar. 20, 1990

[30] Foreign Application Priority Data

Feb. 23, 1989 [FR] France ..... 89 03831

[51] Int. Cl.[5] ..... B24B 9/14; B24B 49/00

[52] U.S. Cl. ..... 51/165.87; 51/284 E; 51/106 LG; 51/101 LG

[58] Field of Search ..... 51/165.87, 165 R, 101 LG, 51/105 LG, 106 LG, 284 E

[56] References Cited

U.S. PATENT DOCUMENTS 4,829,715 5/1989 Langlois et al. ..... 51/165.75

FOREIGN PATENT DOCUMENTS 0235021 9/1987 European Pat. Off. ..... 51/101 LG 2481635 11/1981 France ..... 51/101 LG

*Primary Examiner*—Robert A. Rose

*Attorney, Agent, or Firm*—Martin Smolowitz

[57] ABSTRACT

In a method employed by the device, the distance between a shaft (14) of a grinding wheel (13) and a shaft (5) carrying a finished glass (7) in contact with the grinding wheel, is measured by means of a microprocessor (18) controlling a shifting device (11), by bringing a tracer member (9) in contact with a template (8) mounted on the shaft (5), a standard disk (20) being mounted on the shaft (14) coaxial with the grinding wheel (13) for measuring the distance between the shaft (14) and the shaft (5) by bringing the standard disk in contact with the finished glass.

7 Claims, 1 Drawing Sheet

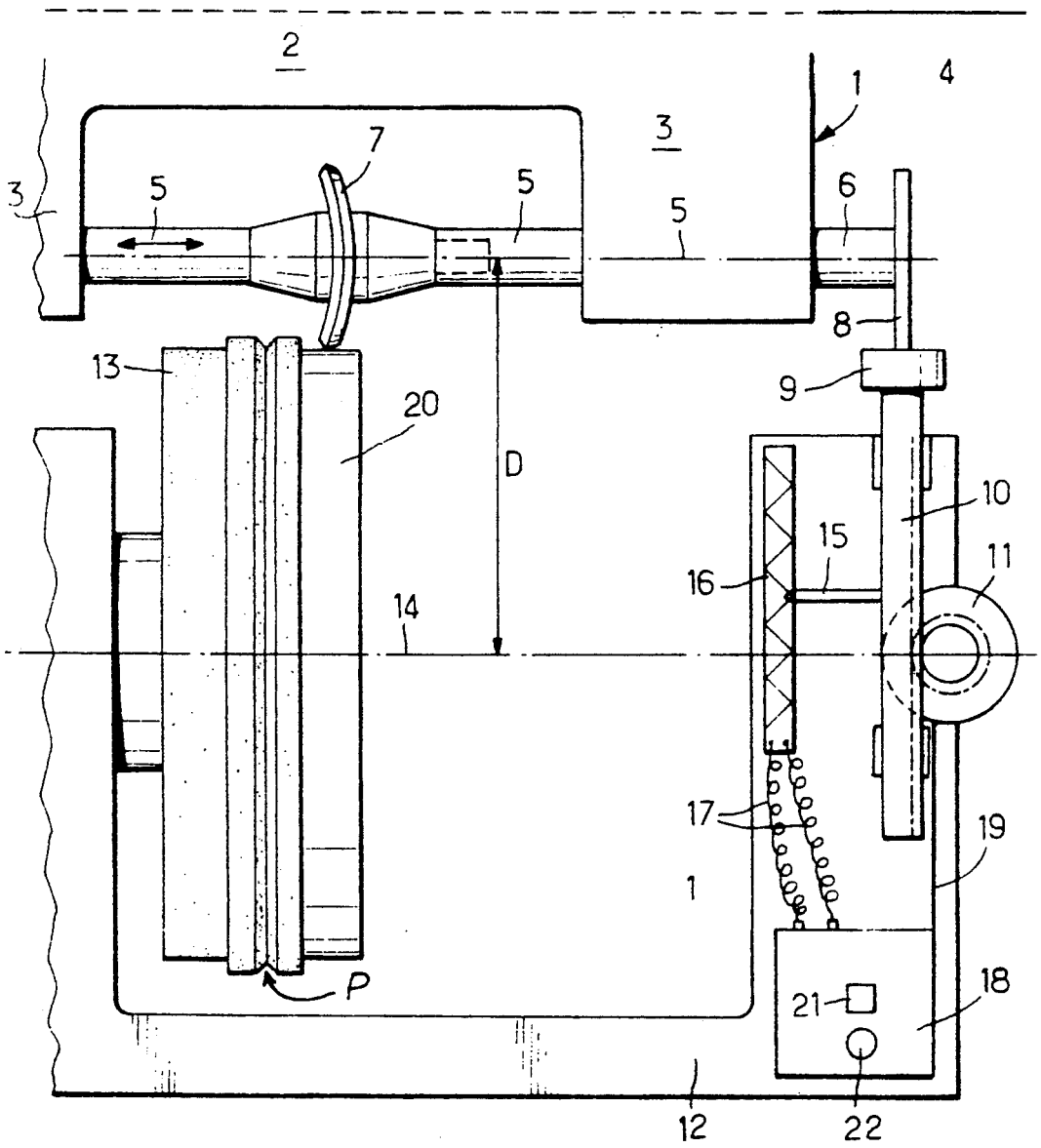
2
1
4
3
7
5
5
5
6
3
8
13
9
20
D
10
15
11
16
14
17
19
1
P
21
18
12
22

DEVICE FOR RECALIBRATING A MACHINE FOR GRINDING OPHTHALMIC GLASSES

BACKGROUND OF THE INVENTION

The present invention relates to machines for grinding ophthalmic glasses and more particularly to the control of the wear of the grinding wheel of such machines.

As is known, a machine for grinding or machining the contour of ophthalmic glasses usually comprises a first fixed and horizontal shaft on which a U-shaped carriage is mounted by an intermediate part of the carriage so as to be slidable in a reciprocating manner, a second shaft parallel to the first shaft and carrying a rotary grinding wheel, and a third shaft parallel to the first and second shafts and rotatably mounted on the ends of the branches of the carriage, divided into two parts between the branches so as to grip between the two parts a glass blank to be ground in accordance with a template, which is carried on an extension of the third shaft outside the branches and bears against a tracer member.

According to French patent No. 2,481,635 in the name of the applicant, a tracer member is mounted to be adjustable in a direction perpendicular to the shaft of the grinding wheel on a rod of a shifting device and connected to a position sensor connected to an electronic device controlling said shifting device.

This electronic device may be associated with a microprocessor which stores in a memory characteristics of a number of glass rims.

Originally, when the grinding machine is brought into service, the distance between the shaft of the grinding wheel and the shaft of a given template is a known value, but this value diminishes with the progressive wear of the grinding wheel, while the diameter of the ground glass on the contrary increases owing to the fact that the shifting device imposes the theoretical distance between the shafts in the course of the rotation of the blank. The operator is consequently obliged to proceed to manual interventions for the purpose of measuring this wear and recalibrating the grinding machine by setting the position of the tracer member.

Document EP-A-0 235 021 describes and shows a machine for grinding ophthalmic glasses which, in one of the embodiments represented in the figures, comprises an adjustable tracer member for bearing against a template connected to a position sensor and mounted on a mechanical shifting device for compensating for the wear of the grinding wheel. In order to permit evaluating the wear of the grinding wheel and to automatically adjust the tracer member for compensating for the wear by modifying the distance between the shafts which respectively carry the grinding wheel and the template, a standard disk is employed and mounted on the shaft instead of a glass blank to be ground, then the distance between the two shafts is measured by bringing the standard disk in contact with the grinding wheel. Apart from these means for indirectly measuring the outside diameter of the grinding wheel, the machine comprises arithmetic means for calculating the amount of wear of the grinding wheel as a function of a measurement effected by the measuring means, adjusting means for adjusting the distance between the shafts driving the grinding wheel and the glass, and control means for controlling the adjusting means in accordance with the amount of wear and thereby achieving a correction of the wear. The adjusting method proposed in this document is, however, difficult and time consuming in use, since it requires putting a standard disk in the place of a glass blank each time it is desired to effect a correcting operation.

SUMMARY OF THE INVENTION

An object of the invention is to provide a method and a device for evaluating in a simple and rapid manner the wear of the grinding wheel, and automatically proceeding to an adjustment of the tracer member for compensating for this wheel wear by returning the distance between the two shafts to its initial value.

The invention therefore provides a method for recalibrating a machine for grinding ophthalmic glasses of the type comprising an adjustable tracer member bearing against a template and connected to a position sensor and mounted on a shifting device controlled by an electronic device as a function of the wear of the grinding wheel, in which a standard disk is fixed on one of the shafts between which the distance must be checked, wherein the standard disk is fixed on the shaft of the grinding wheel, coaxially with the grinding wheel, and said distance between the shafts is measured by bringing the standard disk in contact with a finished glass.

The invention also provides a device for recalibrating a machine for grinding ophthalmic glasses of the type comprising an adjustable tracer member bearing against a template and connected to a position sensor and mounted on a shifting device controlled by an electronic device for compensating for the wear of the grinding wheel, the recalibrating device comprising a standard disk mounted on one of two said shafts whose distance apart must be automatically measured and compensated for, wherein the standard disk is mounted on the shaft of the grinding wheel coaxially therewith.

The standard disk is advantageously mounted against the grinding wheel.

The shifting device is connected to a microprocessor comprising means for displaying the .distance between the shafts of the grinding wheel and the glass, means for controlling the shifting device and adapted to automatically compensate for the difference between the value of said distance between said shafts and its initial value before the wear of the grinding wheel.

The method and the device according to the invention permit effecting in a regular manner a recalibration of the grinding machine with no need to place a standard disk in position in the place of a finished glass or a glass blank, it being possible to effect the recalibrating operation by a simple lateral displacement of the carriage so as to bring the finished glass blank in contact with the outer cylindrical surface of the standard disk, it also being possible for the standard disk to remain permanently in position on the shaft of the grinding wheel.

DESCRIPTION OF THE DRAWING

The following description, with reference to the accompanying drawing given as a non-limitative example, will explain how the invention can be carried out.

In this drawing, the single FIGURE is a diagrammatic plan view of the top of a grinding machine controlled by a microprocessor comprising a recalibrating device according to the invention.

DESCRIPTION OF A PREFERRED EMBODIMENT

With reference to the FIGURE, a conventional grinding machine comprises a generally U-shaped carriage 1 having an intermediate part 2 and two parallel branches 3. The carriage 1 is slidably and pivotally mounted on a horizontal shaft 4 extending in said intermediate part 2 in a direction perpendicular to the branches 3.

Mounted between the branches 3 of the carriage 1 is a rotary shaft 5 in two parts, at least one of which parts includes an extension 6 extending beyond one of the branches 3.

A blank 7 of a glass whose contour is to be machined is centered and gripped between the two semi-shafts 5 between the branches 3, and a template 8 is mounted and centered on the extension 6 of the shaft 5. The template 8 bears against a tracer member 9 fixed on a rod 10 of a shifting device 11 having a motor and mounted on the frame 12 of the machine.

A grinding wheel 13 is mounted on a rotary shaft 14 driven by a motor (not shown).

The rod 10, of the shifting device 11 carries a slider 15 in contact with a linear resistor 16 parallel to the rod 10, and thereby forming a potentiometer producing an electric signal which is a function of the position of the tracer member 9 and is applied through conductors 17 to an electronic device 18 having a microprocessor and connected through a conductor 19 to the shifting device 11.

The grinding machine described hereinbefore is generally known from in particular the document FR-A-2 481 635.

According to the present invention, a standard disk 20 having a diameter equal to the reference circle P of the grinding wheel 13 is coaxially mounted against the grinding wheel on the shaft 14.

The distance D between the axes of the shafts 5 and 14 corresponds to a given value a which is determined by the contact of the template 8 with the tracer member 9, and is equal to the sum of the radius of the reference circle P of the grinding wheel, i.e. of the standard disk 20, and the desired radius of the glass 7 after grinding, i.e. the radius of the template 8. It will be understood that this relationship is valid for all radii of the glass or of the template.

Consequently, there are provided on the electronic device 18 means 21 for displaying the value a and a button 22 controlling the shifting device 11.

It will indeed be understood that there corresponds to the progressive wear of the grinding wheel 13 an equal increase in the diameter of the glass 7 after grinding.

Thereafter, in order to check the state of wear of the grinding wheel, the finished ground glass 7 is brought in contact with the standard disk 20. If the grinding wheel 13 shows no wear, the value a remains displayed by the device 21.

In the opposite case, the diameter of the glass 7 having increased, the value displayed by the device 21 will exceed the value a. By adjusting the position of the shifting device 11 by means of the control button 22, the tracer member 9 is brought back into contact with the template 8 and the device 21 then displays the new value of the distance D.

If the electronic device 18 is adapted to automatically actuate the shifting device 11 so as to maintain the tracer member 9 in contact with the template, this device will read the new value of distance D and will compare it with the initial value and automatically effect the required correction. It will of course be understood that' the standard disk may be detachably mounted on the shaft 14.

What is claimed is:

1. Method for recalibrating a machine for grinding ophthalmic glasses comprising a frame, a first shaft and a second shaft rotatively mounted relative to the frame and spaced a distance apart which must be measured and compensated for, a grinding wheel mounted on the first shaft, a template mounted on the second shaft, means for holding a glass blank to be ground on the second shaft, an adjustable tracer member in bearing relation to the template, a position sensor connected to the tracer member, a shifting device carrying the tracer member, an electronic device connected to the shifting device for controlling the shifting device as a function of the wear of the grinding wheel, a standard disk being fixed on one of said shafts, said method comprising fixing the standard disk on the first shaft coaxially with the grinding wheel and measuring said distance apart by bringing the standard disk in contact with a finished glass held on the second shaft.

2. Device for recalibrating a machine for grinding ophthalmic glasses, said device comprising a frame, a first shaft and a second shaft rotatively mounted relative to the frame and having axes of rotation spaced a distance apart which must be measured and compensated for, a grinding wheel mounted on the first shaft, a template mounted on the second shaft, means for holding a glass blank to be ground on the second shaft, an adjustable tracer member in bearing relation to the template, a position sensor connected to the tracer member, a shifting device, the tracer member being mounted on the shifting device, an electronic device connected to the shifting device for controlling the shifting device and compensating for wear of the grinding wheel, the recalibrating device further comprising means for contacting the glass blank during recalibration, wherein said contacting means comprises a standard disk mounted on the first shaft coaxially with the grinding wheel, the standard disk having substantially the same diameter as that of said grinding wheel.

3. Device according to claim 2, wherein the standard disk is mounted against the grinding wheel.

4. Device according to claim 2, further comprising a microprocessor connected to the shifting device and including means for displaying a value of the distance between the axes of rotation of the first shaft and second shaft, means for controlling the shifting device and adapted to automatically compensate for a difference between a value of said distance between the axes and an initial value therof prior to wear of the grinding wheel.

5. The device according to claim 3, wherein the standard disk is detachably mounted on the first shaft.

6. A device for recalibrating a machine for grinding ophthalmic glasses, said device comprising a frame, a first shaft and a second shaft rotatively mounted relative to the frame and having axes of rotation spaced a distance apart which must be measured and compensated for, a grinding wheel mounted on the first shaft, a template mounted on the second shaft, means for holding a glass blank to be ground on the second shaft, an adjustable tracer member in bearing relation to the template, a position sensor connected to the tracer member, a shifting device, the tracer member being mounted on the shifting device, an electronic device connected to the shifting device for controlling the shifting device and compensating for wear of the grinding wheel, the recalibrating device further comprising means for contacting the glass blank during recalibration, wherein said contacting means comprises a standard disk mounted on the first shaft coaxially with and adjacent to the grinding wheel, the standard disk having substantially the same diameter as that of the grinding wheel, and a microprocessor connected to the shifting device and including means for displaying a value of the distance between the axes of rotation of the first shaft and second shaft, means for controlling the shifting devices and adapted to automatically compensate for a difference between a value of said distance between the axes and an initial value thereof prior to wear of the grinding wheel.

7. The method according to claim 1, including adjusting the position of the tracer member as needed to bring it back into contact with the template.

* * * * *